United States Patent [19]

Yaguchi

[11] 3,937,617

[45] Feb. 10, 1976

[54] CATALYTIC CONVERTER FOR AUTOMOTIVE INTERNAL COMBUSTION ENGINE

[75] Inventor: Hiroshi Yaguchi, Yokohama, Japan

[73] Assignee: Nissan Motor Company, Limited, Japan

[22] Filed: July 10, 1974

[21] Appl. No.: 487,367

[30] Foreign Application Priority Data

July 11, 1973 Japan ..... 48-82287[U]

[52] U.S. Cl...... 23/288 FC; 23/288 FB; 29/DIG. 1; 29/DIG. 48; 138/112; 228/175

[51] Int. Cl.[2]..... B01J 8/00; F01N 3/15

[58] Field of Search ..... 23/288 FC; 60/295, 299; 252/477 R; 138/112

[56] References Cited

UNITED STATES PATENTS

| | | | |
|---|---|---|---|
| 3,172,251 | 3/1965 | Johnson | 23/288 FC UX |
| 3,189,418 | 6/1965 | Gary | 23/288 FC UX |
| 3,211,534 | 10/1965 | Ridgway | 23/288 FC UX |
| 3,362,783 | 1/1968 | Leak | 23/288 FC X |
| 3,692,497 | 9/1972 | Keith et al. | 23/288 FC |
| 3,771,967 | 11/1973 | Nowak | 23/288 FC |
| 3,785,781 | 1/1974 | Hervert et al. | 23/288 FC UX |
| 3,798,006 | 3/1974 | Balluff | 23/288 FC |

*Primary Examiner*—Barry S. Richman
*Attorney, Agent, or Firm*—Robert E. Burns; Emmanuel J. Lobato; Bruce L. Adams

[57] ABSTRACT

A catalytic converter having a metallic resilient flexible member to tightly hold a unitary, solid skeletal catalytic element within a casing of the catalytic converter. The member is bonded with the outer surface of the catalytic element via a ceramic cement and with the inner surface of the casing of the converter via a plurality of plugs of weld metal formed in openings in a lateral wall of the casing and effective to bond the member to the casing.

6 Claims, 1 Drawing Figure

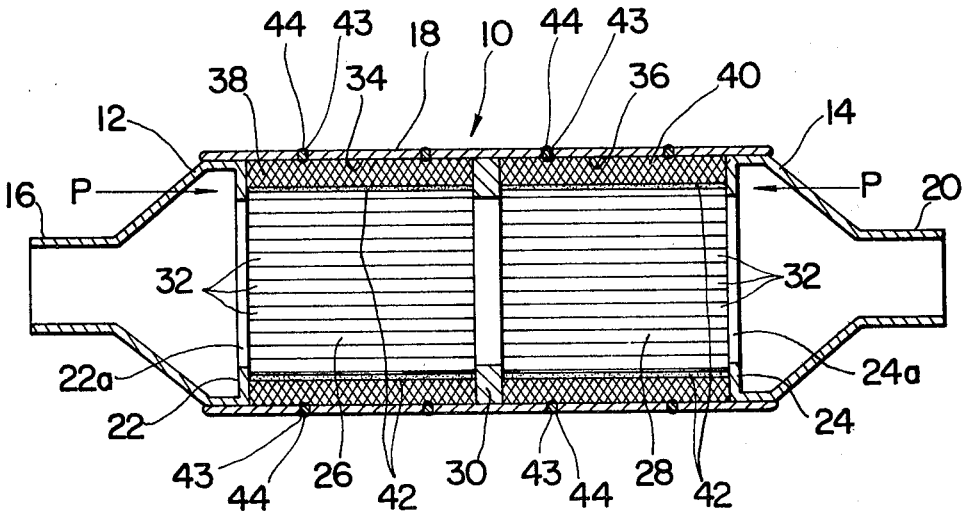
44
43
18
10
44
43
38
34
36
40
12
14
16
P
P
20
32
32
22a
24a
22
24
43
44
26
42
30
43
44
28
42

CATALYTIC CONVERTER FOR AUTOMOTIVE INTERNAL COMBUSTION ENGINE

This invention relates to a catalytic converter for use in an exhaust system of an automotive internal combustion engine and, more particularly to a catalytic converter having a structure which will secure a unitary catalytic element therein.

It is well known that a catalytic converter has been employed in an exhaust system of an automotive internal combustion engine for conversion of pollutants from the engine to less objectionable materials.

It is also well known that a catalytic converter having such a construction as will be mentioned hereinafter is in practical use. The catalytic converter has a cylindrical casing section which houses a unitary monolithic catalytic element having a plurality of gas flow channels or paths therethrough. The cylindrical casing is generally metallic, while the catalytic element is made of refractory ceramic material. A gas inlet and outlet are provided at their respective ends of the cylindrical casing. The outside diameter of the catalytic element, which is also generally cylindrical, is somewhat smaller than the internal diameter of the cylindrical casing in order to permit insertion of the catalytic element into the casing after each of these members has been separately formed.

In order to secure the catalytic element tightly within the casing a resilient flexible member such as metallic mesh fabric is positioned under compression between the casing and the catalytic element. Each end of the catalytic element is in contact with a flange which projects inwardly from the inner surface of the cylindrical casing. These flanges extend completely around the inner circumference of the casing and extend far enough towards the middle of the casing to bridge the space between the casing and the catalytic element and sufficiently across the respective faces of the latter to hold it against longitudinal movement within the cylindrical casing.

Although this prior art catalytic converter has given excellent service in purifying the exhaust of internal combustion engines, there are circumstances in which, during elevated temperatures, the metallic casing expands longitudinally and in diameter with respect to the catalytic element; the thermal expansion of the metal being considerably larger than that of the ceramic material. Accordingly, tight contact between the each end of the catalytic element and the flange mentioned above is lost and play occurs between both members. In addition, the securing effect on the catalytic element by the resilient flexible member mentioned above is reduced.

As a result, the catalytic element becomes displaced longitudinally within the cylindrical casing under the influence of engine vibration and pulsation of exhaust gas. Each end face of the catalytic element is therefore subjected to grinding or attrition where it contacts the flange mentioned above. This attrition leads to physical damage or total breakdown of the catalytic element.

Accordingly, it is an object of the present invention to provide an improved catalytic converter construction which will eliminate these drawbacks encountered in the prior art.

It is another object of the present invention to provide an improved catalytic converter construction by which the catalytic element made of refractory ceramic material within the casing of the converter will not be subjected to physical damage or total breakdown thereof.

It is further object of the present invention to provide an improved catalytic converter construction in which the catalytic element is fixedly disposed in the casing of the converter.

These and other objects and advantages of the present invention will become more apparent from the following description when taken in conjunction with the accompanying drawing in which:

The single FIGURE is a longitudinal cross-sectional view of an embodiment of a catalytic converter according to the present invention.

Referring now to the drawing, exhaust gas catalytic converter 10 having frusto-conical end closure members 12 and 14 can be connected to a source of exhaust gases passing from an internal combustion engine (not shown) by conduit 16. The exhaust gases may be mixed with oxygen source, e.g. air, prior to entering conduit 16.

The catalytic converter 10 comprises a cylindrical metallic casing 18. The frusto-conical metallic end closure members 12 and 14 are secured at the gas inlet and outlet ends, respectively, of casing 18 by welding or other means.

The frusto-conical member 12 is so dimensioned as to enable distribution or passage of the exhaust gases over the entire or substantially entire cross-sectional area of the upstream portion of casing 18. The frusto-conical member 14 is of similar dimensions as the frusto-conical member 12 as shown, and of such dimensions as to enable free passage of gas out of the converter without causing substantial back pressures. The inlet conduit 16 is integral with the frusto-conical member 12 as shown, and outlet conduit 20 is integral with the frusto-conical member 14 as shown. Both the frusto-conical members 12 and 14 respectively have similar inwardly-protruding member or annular flanges 22 and 24. As shown, the annular flanges 22 and 24 are respectively integral with the frusto-conical members 12 and 14 and are formed by bending inwardly the inner terminal end portions of the frusto-conical members 12 and 14. The annular flanges 22 and 24 respectively form a gas inlet opening **22*a* and a gas outlet opening 24*a*** therethrough.

Between the annular flanges 22 and 24, a pair of catalytic elements 26 and 28 are secured in series. An annular spacer 30 is interposed between the both catalytic elements 26 and 28. The catalytic elements 26 and 28 are generally cylindrical and respectively have unitary solid skeletal structures having a plurality of gas flow channels or paths 32 therethrough. On the inner surfaces of the channels 32, a catalytic material such as a platinum group metal is carried.

Annular spaces or gaps 34 and 36 of substantially uniform width are defined between the inner surface of cylindrical casing 18 and the outer surfaces of the catalytic elements 26 and 28. The spaces 34 and 36 extend completely around the catalytic elements 26 and 28 respectively along the entire length of the element structures.

The flanges 22 and 24 extend completely around the inner circumference of the casing 18 and extend far enough towards the middle of the casing 18 to bridge the spaces 34 and 36 between the casing 18 and the catalytic elements 26 and 28, and sufficiently across the outer faces of the latter to hold them against longitudinal movement within the cylindrical casing 18.

Within the annular spaces 34 and 36, resilient means 38 and 40 or resilient flexible member such as a wound metallic mesh fabric are disposed under compression in order to hold the catalytic elements 26 and 28 tightly and to absorb mechanical shock of the same.

The inner surfaces of the resilient means 38 and 40 are respectively bonded with the outer surfaces of the catalytic elements 26 and 28 by any suitable heat resistant adhesive or first bonding means 42 such as a ceramic cement, while the outer surfaces of the resilient means 38 and 40 are bonded with the inner surface of the casing 18 by suitable bonding means or second bonding means 44 such as a plurality of plugs of weld metal each formed in one of a plurality of openings 43 opened through the casing 18 to bond the resilient means 38 and 40 to the casing 18.

The catalytic converter according to the present invention may be manufactured by the procedure mentioned hereinafter. First the outer surfaces of the cylindrical catalytic elements 26 and 28 are coated with a heat resistant adhesive 42 such as a ceramic cement. Then layers of the resilient means 38 and 40, such as the wound metallic mesh fabric, are formed and bonded with the adhesive. Thereafter, this component is inserted into a metallic casing 18 which has a plurality of the openings 43 therethrough. Through the openings 43, plug welding bonds the resilient means 38 and 40 with the inner surface of the cylindrical casing 18. Lastly the frusto-conical members 12 and 14 are secured on both ends of the catalytic elements 25 and 26 with preload P as shown in the drawing.

According to the present invention, when expansion of the metallic casing occurs, the longitudinal movement of the catalytic elements 26 and 28 within the casing 18 is prevented. Thus they are not subjected to the grinding action or attrition where they contact the folding flanges 22 and 24 because the catalytic elements 26 and 28 are bonded to the resilient means 38 and 40 with the heat resistant adhesive 42 and the resilient means 38 and 40 are in turn fixed to the metallic casing 18 with plug welding.

In order to prevent deformation and breakdown of the resilient means 38 and 40 which are fixedly interposed between the casing 18 and the catalytic elements 38 and 40, the casing is preferably made of a steel plate having relatively low coefficient of thermal expansion such as of ferrite steel (coefficient of expansion about $11.7 \times 10^{-6}/°C$, average within 0°–800°C), while a known casing is generally made of a steel plate having relatively high coefficient of thermal expansion such as of austenite steel (coefficient of expansion about $20 \times 10^{-6}/°C$, average within 0°–800°C).

What is claimed is:

1. In a catalytic converter of the type having a metallic casing; a unitary, solid skeletal catalytic element disposed within said casing; and metallic resilient means disposed between said catalytic element and said metallic casing for positioning said catalytic element and for absorbing mechanical shocks; the improvement comprising:

means defining a plurality of openings through a lateral wall of said metallic casing; and a plurality of plugs of weld metal, each of said plugs formed in a respective one of said openings and effective to bond said metallic resilient means with said metallic casing.

2. A catalytic converter for purifying internal combustion engine exhaust gases, comprising:

a metallic casing defining an enclosed space, and having a gas inlet and a gas outlet at opposite ends thereof and a plurality of openings through a lateral wall of the casing;

a catalytic element of lesser dimensions than said enclosed space and positioned within said casing, said catalytic element having a unitary, solid skeletal structure having a plurality of gas flow channels therethrough for providing communication from said gas inlet to said gas outlet, and a catalytic material disposed on surfaces of said channels;

metallic resilient means compressively encompassing the catalytic element for positioning the catalytic element and for absorbing mechanical shocks, said metallic resilient means disposed between said element and the inner surface of said lateral wall of said casing;

first bonding means for bonding said resilient means with said catalytic element, said first bonding means comprising heat resistant adhesive; and second bonding means for bonding said metallic casing with said resilient means, said second bonding means comprising a plurality of plugs of weld metal, each of said plugs formed in a respective one of said openings and effective to bond said resilient means with said metallic casing.

3. A catalytic converter according to claim 2 wherein said catalytic element has upstream and downstream end faces and further comprising an inwardly-protruding member on the interior of said casing in contact with said resilient means and located adjacent to and abutting the outer perimeter of one of said end faces to hold the catalytic element against longitudinal movement within said casing.

4. A catalytic converter according to claim 2, in which said casing is made of ferrite steel.

5. A catalytic converter according to claim 2, in which said resilient means includes a wound metallic mesh fabric.

6. A catalytic converter according to claim 2, in which said heat resistant adhesive includes a ceramic cement.

* * * * *